United States Patent [19]

Kerns

[11] 4,057,922

[45] Nov. 15, 1977

[54] METHOD AND DEVICE FOR LIVESTOCK RECORD KEEPING

[75] Inventor: Steven L. Kerns, Ames, Iowa

[73] Assignee: Management Utilities, Inc., Ames, Iowa

[21] Appl. No.: 705,801

[22] Filed: July 16, 1976

[51] Int. Cl.[2] ..... G09F 1/10

[52] U.S. Cl. ..... 40/124.2; 40/107

[58] Field of Search ..... 40/68, 110, 124.2, 124.4, 40/107

[56] References Cited

U.S. PATENT DOCUMENTS

| | | | |
|---|---|---|---|
| 2,496,490 | 2/1950 | Phillips | 40/68 |
| 3,406,474 | 10/1968 | Bates | 40/110 |

*Primary Examiner*—Louis G. Mancene

*Assistant Examiner*—Wenceslao J. Contreras

*Attorney, Agent, or Firm*—Zarley, McKee, Thomte, Voorhees & Sease

[57] ABSTRACT

A method and means for livestock record keeping. The means comprises a frame, with a rotatable wheel mounted on the frame, the wheel having a plurality of card holding slots radially positioned therearound, with the frame having a marking path positioned around the periphery of the rotable wheel. The method comprises determining a specific date on which a work function is to be performed, marking the day to provide a marked path, and moving at daily increments a symbol representing a given animal along said marked path so that when said symbol and a mark on the marked path coincide, a livestock keeper will know when a certain work function is to be performed.

5 Claims, 2 Drawing Figures

METHOD AND DEVICE FOR LIVESTOCK RECORD KEEPING

BACKGROUND OF THE INVENTION

A problem often encountered in raising and feeding livestock such as cattle and hogs is difficulty in keeping records for the animals. This is especially difficult with today's increased livestock herds and today's methods of animal breeding and raising which often involve confined feeding and keeping of animals. Thus, a livestock feeder or an animal breeder or raiser will have a variety of different animals which need certain work functions to be performed at differing times. For example, when cows or pigs become pregnant certain critical functions must be performed during the gestation period at dates certain in order to keep both the mother and the unborn animal in good healthy condition. For example, innoculations need to be given on certain specified dates, feed formulas need to be changed at certain stages of the animal's life, and the livestock owner needs to know when he can expect newborn calves, pigs or the like.

Typically in order to allow record keeping each animal is marked or tagged, often by a number tag or the like. Thus, each specific animal is identifiable in a livestock keeper's herd. However, keeping track of the work functions to be performed on an animal, even though that animal may be specifically identified by a number tag or the like, is often a difficult record keeping problem. This is especially true in today's livestock raising which with increased size in operations often involves many, many animals.

This invention has as its primary object providing a method and means of livestock record keeping which is efficient, easy to operate, provides minimum chance for error in record keeping, provides a device which is simple in structure and economical for manufacture, and importantly provides a device which has versatility in that it can be readily adapted for use with a variety of livestock animals, for example, both cattle and swine.

The method of accomplishing all of the above stated objectives, as well as others, will become apparent from the detailed description which will follow below.

DETAILED DESCRIPTION OF THE INVENTION

Figure 1:
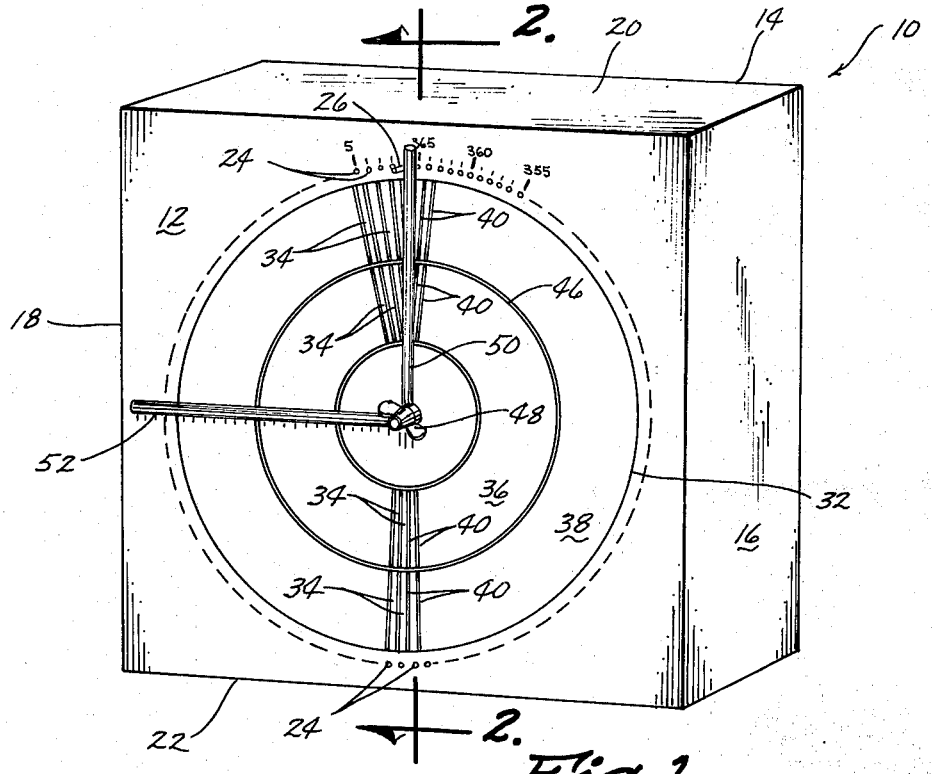
FIG. 1 is a frontal, elevated perspective view of the device of this invention.
Figure 2:
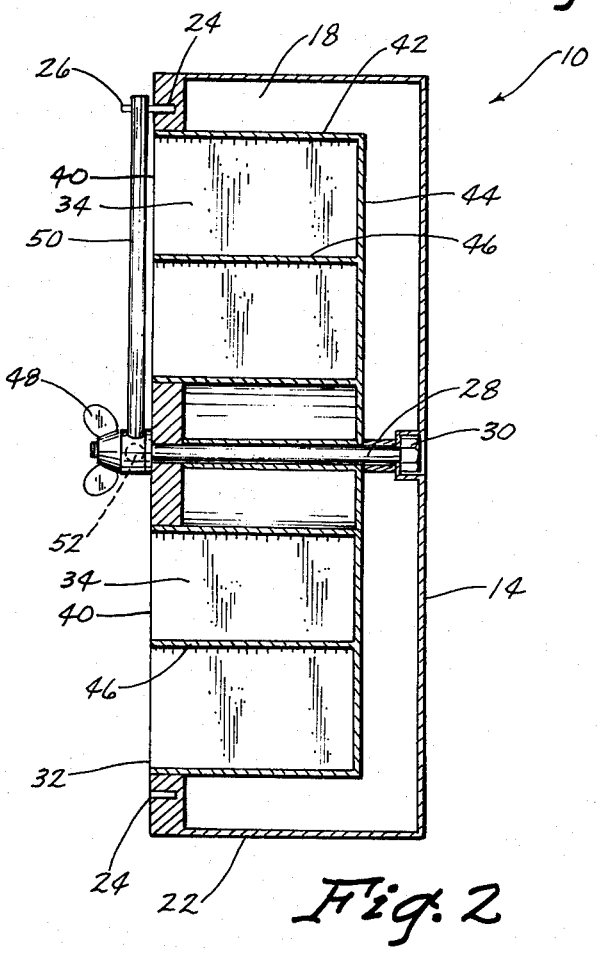
FIG. 2 is a cross-sectional view of the device of this invention along line 2—2 of FIG. 1.

The record keeping device, referred to generally by 10, has a box like frame comprised of a front wall 12, a spaced apart rear wall 14, oppositely disposed side walls 16 and 18, and top wall 20 and bottom surface 22. Front wall 12 has a circular cut out, around the periphery of which are a plurality of spaced apart peg receiving holes 24. Peg receiving holes 24 are evenly spaced around the periphery of the circular cut-out in front wall 12 to provide 367 peg holes, one peg hole representing each day of the year. Pegs 26 are provided for insertion into peg holes 24.

Mounted in supporting relationship to rear wall 14, in conventional fashion, and extending forwardly therefrom in perpendicular relationship with respect to rear wall 14, is axle 28 which extends through the circular cut-out in front wall 12 at its mid-point. Axle 28 is supported at the rear by conventional axle mount 30.

Wheel 32 is rotatably mounted on axle 28 and substantially fills the cut-out in front wall surface 12 of the frame. Wheel 12 is comprised of a plurality of compartments 34 concentrically positioned around wheel 32. More specifically, there is provided an inner circle of compartments 36 and an outer circle of compartments 38. As depicted in FIG. 1, the compartments are provided by a plurality of dividers 40 which extend from the front face of wheel 32 rearwardly. Thus, the front face of wheel 32 is comprised of a plurality of compartments 34 arranged to provide an inner compartment circle 36 and an outer compartment circle 38 with the open space of each compartment facing outwardly for receipt of cards or the like. Around the periphery of wheel 32 is provided peripheral wall 42 which adjoins at its back side rear wall 44. Circular divider 46 extends from rear wall 44 forwardly to divide wheel 32 into the inner compartment circle 36 and outer compartment circle 38.

The wheel 32 is rotably mounted to axle 28 via wing nut 48 which is threadably received on the outer end of axle 28. Radially extending marking rods 50 and 52 are mounted on the outer end of axle 28 prior to threadable receipt of wing nut 48. Radially extending marking rods 50 and 52 are mounted in spaced apart relationship as shown to indicate the gestation period for the particular animal for which records are being kept, with one rod 50 at the day one, 12:00 o'clock position and the other rod 52 at the end of the gestation period. Rods 50 and 52 are in a fixed relationship with respect to rotary wheel 32.

In actual operation the device of this invention works as follows: A card representing a given animal or group of animals is placed in slot 1, for example, on the day of impregnation. If, for example, all of the animals impregnated on day one are to have certain shots on day seven, after impregnation, an innoculation peg 26, marked by a color code or the like, is placed in the peg hole 24 corresponding to day 7 after impregnation. Rotary wheel 32 is moved counterclockwise by daily increments and when the first compartment of outer circle 38 corresponds to day seven, all of the animals represented by the card in this slot are innoculated. Rotation of wheel 32 in a clockwise direction is continued with the work function performed when each compartment coincides with the given peg 24 positioned on the outer periphery of front wall 12. When the wheel has rotated to marking rod 52, the gestation cycle is completed and the animal is ready for birth. After birth, the cards are moved from the inner compartment circle 38 to the outer compartment circle 36 and rotation is continued with the work functions being performed at each interval wherein a compartment carrying animal cards corresponds with the color coded peg for work functions such as changing feed rations or the like. Thus, as can be seen, an efficient, easy to operate, simple and economical to manufacture as well as versatile record keeping device has been provided. The device provides for a minimum chance of error as long as the operator makes the daily incremental movement of the wheel. Moreover, versatility is provided in that the gestation period for differing animals can be marked by radially extending marking rods 50 and 52 by moving those to provide a different space therebetween.

What is claimed is:

1. A livestock record keeping device comprising a frame, means for rotatably mounting a wheel on said frame, a wheel rotatably mounted on said means, said wheel having a plurality of animal symbol holding means positioned therearound, said frame having a plurality of peg receiving apertures representing each day of the year around the periphery of said wheel, and a plurality of radially extending adjustably spaced apart marking rods mounted on said wheel.

2. The device of said claim 1 wherein said symbol holding means are a plurality of compartments.

3. The device of claim 1 wherein said wheel has two concentric circles of animal symbol holding means.

4. The device of claim 1 wherein said rods are spaced apart to mark the gestation period of the particular animals for which records are being kept.

5. A method of keeping records of work functions to be performed on livestock or the like, said method comprising, determining from a specific date the precise number of days until a given work function needs to be performed, placing a marking peg for each work function to be performed in the peg receiving aperture corresponding to the day the particular work function is to be performed, to provide a marked path, and moving at daily increments a symbol representing a given livestock animal or group of livestock animals along said marked path, whereby when said symbol and said marking peg on said marked path coincide, a livestock keeper will know said work function is to be performed.

* * * * *